US005988281A

United States Patent [19]

Douglas et al.

[11] Patent Number: 5,988,281

[45] Date of Patent: Nov. 23, 1999

[54] ENGAGEABLE METAL SEAL PRESSURE BALANCED STAB

[75] Inventors: Larry D. Douglas, Cypress; Jon D. Buck, Tomball, both of Tex.

[73] Assignee: Oceaneering International Inc., Houston, Tex.

[21] Appl. No.: 08/788,688

[22] Filed: Jan. 24, 1997

[51] Int. Cl.[6] ..... E21B 43/01; F16L 1/04

[52] U.S. Cl. ..... 166/344; 405/169

[58] Field of Search ..... 166/344, 341, 166/342, 343, 338, 339; 405/169, 191

[56] References Cited

U.S. PATENT DOCUMENTS

| | | | |
|---|---|---|---|
| 4,097,069 | 6/1978 | Morrill | 285/84 |
| 4,294,471 | 10/1981 | Van Bilderbeek | 285/24 |
| 4,593,937 | 6/1986 | Schawann et al. | 166/344 X |
| 4,620,818 | 11/1986 | Langner | 166/343 X |
| 4,673,041 | 6/1987 | Turner et al. | 166/344 X |
| 4,676,696 | 6/1987 | Laursen | 166/338 X |
| 4,863,314 | 9/1989 | Baugh | 166/338 X |
| 4,878,783 | 11/1989 | Baugh | 166/344 X |
| 5,143,483 | 9/1992 | Petersen | 166/340 X |

*Primary Examiner*—Frank Tsay

*Attorney, Agent, or Firm*—Rosenblatt & Redano P.C.

[57] ABSTRACT

The present invention provides for the connection of a pressure balanced stab and a manifold in which offsetting forces maintained on the stab allow it to remain in an inserted state within the manifold without the use of a significant amount of force to maintain the connection. The offsetting forces are contained within the stab through the use of C-ring seals on the stab, which are activated by a downward force created by an actuator. The compression of the C-rings is delayed until insertion is complete, therefore allowing an installation which does not damage the seals. The O-ring designs, used in prior pressure balanced stabs, are likely to be damaged upon insertion of the stab into the receptacle. The damage to the O-ring seals takes place when the O-ring, partially protruding from the stab, makes contact with the surface of the receptacle in such a manner that causes the O-ring seal to tear or become manipulated in a way that creates an ineffective seal. The preferred embodiment allows for activation of the C-ring seal to take place following insertion of the stab within the receptacle and therefore the C-ring does not encounter interference from the surface of the receptacle until it is activated. In addition to the prevention of damage to the C-ring seal, the preferred embodiment allows for the seal to withstand greater pressure than prior O-ring designs.

22 Claims, 2 Drawing Sheets

ENGAGEABLE METAL SEAL PRESSURE BALANCED STAB

FIELD OF THE INVENTION

The present invention relates to stab assemblies utilized in oil and gas applications particularly in subsea production environments.

BACKGROUND OF THE INVENTION

In subsea operations such as oil and gas exploration it is common to utilize a stab containing a flowline for charging and discharging of liquids within a manifold. Various engagement mechanisms are used in connecting and maintaining the connection between the stab and the manifold. Seals are placed on the stab and are used to maintain the connection between the stab and the manifold. The seals are positioned within the stab in such a manner that the hydrostatic pressure maintained in the lower end of the stab exerts an upward force while the hydrostatic pressure at the upper end of the stab exerts an equal downward force. A lateral outlet port in which fluids can be discharged is provided between the seals. The offsetting forces create a stab that remains as positioned within the manifold.

In a conventional stab assembly the seals consist of O-rings placed on the stab. Once the stab is submerged, these seals facilitate the connection of the stab to the manifold. The disadvantage with the O-ring seal design and other commonly used seals is that during insertion of the stab into the manifold the seals may become damaged, which would result in receptacle leakage.

It is therefore an object of the present invention to provide a unique sealing arrangement which allows dependable sealing at much higher pressures, i.e. greater than 15,000 pounds per square inch, than the seals used in hydraulic stabs.

SUMMARY OF THE INVENTION

The present invention provides for the connection of a pressure balanced stab and a manifold in which offsetting forces maintained on the stab allow it to remain in an inserted state within the manifold without the use of a significant amount of force to maintain the connection. The offsetting forces are contained within the stab through the use of C-ring seals on the stab, which are activated by a downward force created by an actuator. The compression of the C-rings is delayed until insertion is complete, therefore allowing an installation which does not damage the seals. The O-ring designs, used in prior pressure balanced stabs, are likely to be damaged upon insertion of the stab into the receptacle. The damage to the O-ring seals takes place when the O-ring, partially protruding from the stab, makes contact with the surface of the receptacle in such a manner that causes the O-ring seal to tear or become manipulated in a way that creates an ineffective seal. The preferred embodiment allows for activation of the C-ring seal to take place following insertion of the stab within the receptacle and therefore the C-ring does not encounter interference from the surface of the receptacle until it is activated. In addition to the prevention of damage to the C-ring seal, the preferred embodiment allows for the seal to withstand greater pressure than prior O-ring designs.

DETAILED DESCRIPTION OF THE PREFERRED EMBODIMENT

Figure 1:
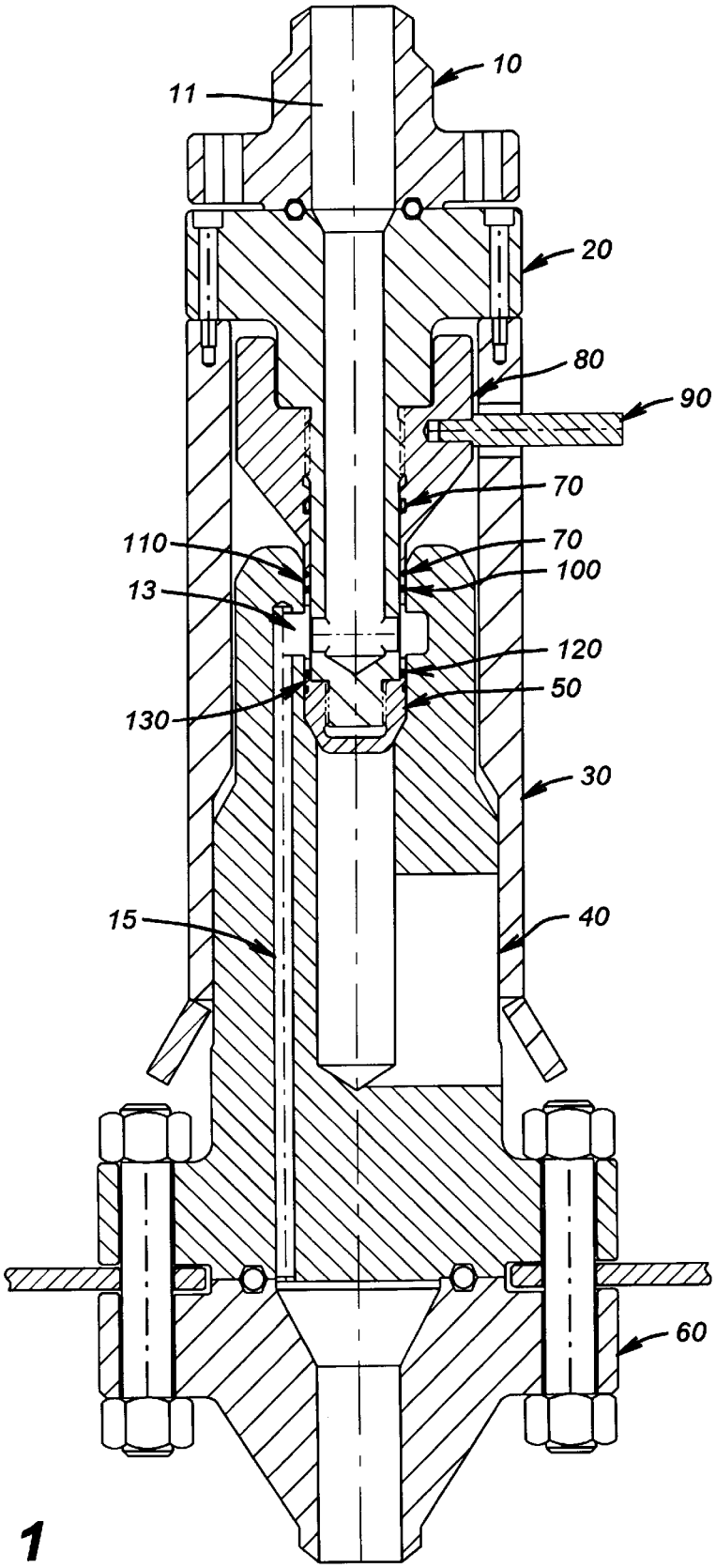
FIG. 1 is a cross section view of an engageable metal seal pressure balanced stab.
Figure 3:
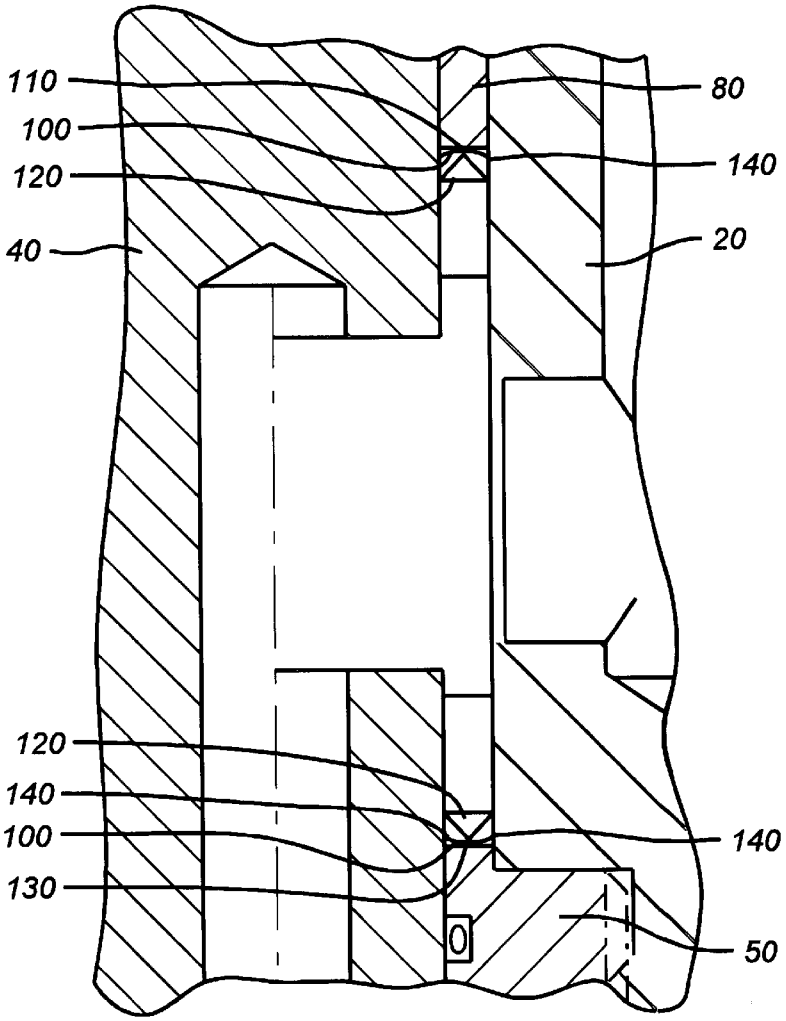
FIG. 3 is a cross section view of the C-rings subsequent to activation of the actuator and compression of the C-rings.
Figure 2:
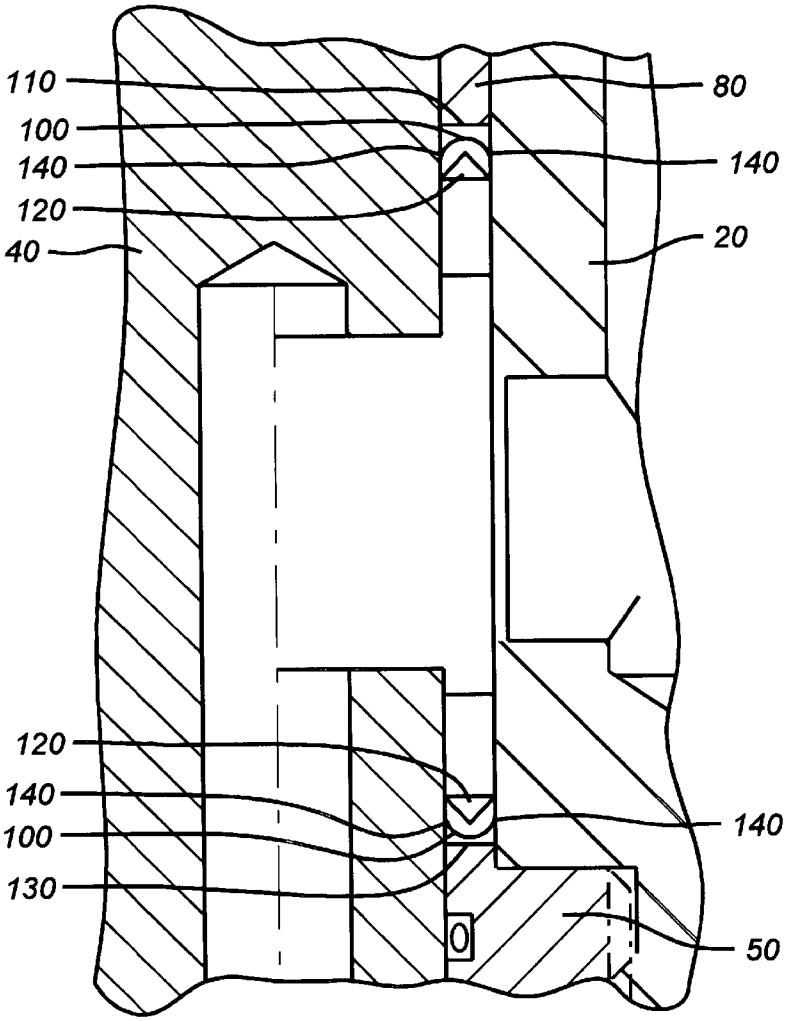
FIG. 2 is a cross section view of the C-rings prior to compression.

As illustrated in FIG. 1, an engageable stab consists of a flowline interface 10 connected to a stab body 20 which is contained within a guide skirt 30. The guide skirt 30 is positioned upon a manifold receptacle 40 used in attaching the stab nose 50 into the tree interface flange 60. The flowline 11 allows for liquids to pass through a lateral port 13 and then continue on through a downhole flowline 15. Because of the subsea environment in which the stab is used, the stab body 20 contains numerous contaminate seals 70 used for sealing out foreign matter which could enter the stab body 20 upon submersion. An actuator 80, which is activated by the rotation of the actuator lever 90, is propelled along the longitudinal axis of the stab toward the tree interface flange 60. As illustrated in FIG. 2, once the stab body 20 is within the manifold receptacle 40 and the actuator 80 is activated, a downward force is placed upon the metal C-rings 100 from the lower end 110 of the actuator 80. The lower end 110 of the actuator 80 presses the C-ring 100 and the lantern or support ring 120 together against the stationary shoulder 130 of the stab body 20. As the C-ring 100 is pressed against the lantern ring 120, the legs 140 of the C-ring 100 which define a circular opening therebetween are forced to flare outwardly away from the center of the C-ring 100 and toward the stab body 20 surface and the wall defining the opening in the manifold receptacle 40 surface. As illustrated in FIG. 3, once the C-ring 100 has been compressed upon the lantern ring 120, a seal is created that can withstand greater pressures than an O-ring design (i.e. in excess of 15,000 PSI) and which has not been subjected to shear forces created by contact between the stab body 20 surface and the wall defining the opening in the manifold receptacle 40 on insertion When inserting a stab body 20 by a remotely operated vehicle (ROV), the shear forces using O-rings had to be overcome by the ROV. Shear forces could exceed the ROV's limits or result in a seal failure on makeup. While two seals 100 are shown, other numbers of seals can be used with or without a lantern ring 120 without departing from the spirit of the invention.

Many modifications and variations may be made in the embodiments described herein and depicted in the accompanying drawings without departing from the concept of the present invention. Accordingly, it is clearly understood that the embodiments described and depicted herein are illustrative only and are not intended as a limitation upon the scope of the present invention.

What is claimed is:

1. A subsea stab connection insertable into a subsea manifold receptacle, comprising:

a subsea manifold having at least one receptacle defined by a wall;

a stab configured for insertion into said manifold receptacle, said stab having a longitudinal axis;

a seal on said stab;

an actuating member on said stab movable longitudinally to contact said seal for longitudinal compression thereof, said longitudinal compression results in radial expansion of said seal against said manifold receptacle; and said seal entering said receptacle without interference from said wall, whereupon insertion of said stab to its desired position in said receptacle, said actuating member is operable to act on said seal to position it to seal between said stab and said wall defining said receptacle.

2. The stab of claim 1 wherein:

said stab comprises a support surface for said seal; and said actuating member, upon insertion of said stab into said receptacle, bearing down on said seal against said support to move said seal into engagement with said wall.

3. A subsea stab connection insertable into a subsea manifold receptacle, comprising:

a subsea manifold having at least one receptacle defined by a wall;

a stab configured for insertion into said manifold receptacle;

a seal on said stab;

an actuating member on said stab;

said seal entering said receptacle without interference with said wall, whereupon insertion of said stab to its desired position in said receptacle, said actuating member is operable to act on said seal to position it to seal between said stab and said wall defining said receptacle;

said seal comprises a first ring seal having a circumferential opening; and a support ring mounted adjacent said opening;

whereupon actuation of said actuating member, said support ring is forced against said opening to splay portions of said ring seal in opposed directions to sealingly contact said wall of said receptacle.

4. The stab of claim 3 wherein:

said seal comprises a second ring seal having a circumferential opening and mounted with its opening facing said support ring on the other end of said support ring from said first ring seal, whereupon actuation of said actuating member said support ring is forced against said openings in said first and second ring seals to splay portions of said first and second ring seals against said wall for sealing therewith.

5. The stab of claim 4 wherein:

said support ring has at least one tapered end to facilitate said splaying of portions of at least one of said seals against said wall.

6. The stab of claim 5 wherein:

said actuator comprises a movable nut.

7. The stab of claim 6 wherein:

said nut is actuable from outside said manifold after insertion of said stab into said receptacle.

8. The stab of claim 7 wherein:

said nut is threaded to said stab.

9. The stab of claim 8 wherein:

said nut comprises a handle to facilitate subsea operation by a remotely operated vehicle.

10. The stab of claim 3, wherein:

said actuator comprises a threaded nut; and said assembly being insertable into an opening in the manifold without interference with the wall defining the manifold opening until said nut is rotated.

11. A subsea stab connection insertable into a subsea manifold receptacle, comprising:

a subsea manifold having at least one receptacle defined by a wall;

a stab configured for insertion into said manifold receptacle;

a seal on said stab;

an actuating member on said stab;

said seal entering said receptacle without interference with said wall, whereupon insertion of said stab to its desired position in said receptacle, said actuating member is operable to act on said seal to position it to seal between said stab and said wall defining said receptacle;

said stab comprises a support surface for said seal;

said actuating member, upon insertion of said stab into said receptacle, bearing down on said seal against said support to move said seal into engagement with said wall;

said seal has a circumferential opening;

said support comprises a ring engaging said opening; and said actuator forcing said seal against said support, whereupon a portion of said seal advances toward said wall as said support is forced into said opening.

12. The stab of claim 11, wherein:

said seal further comprising a pair of seals having facing circumferential openings and separated by said supporting ring; and said support further comprises a movably mounted nut which is actuable to bear down against the assembly of said seals and said support ring in between said seals to force said assembly against said support surface thereby moving portions of said seals towards said wall.

13. The stab of claim 11 wherein:

said support ring is tapered on at least one end to facilitate its entry into said opening.

14. The stab of claim 11 wherein:

said nut is threaded to said stab and further comprises a handle which can be rotated externally of said manifold such as by a remotely operated vehicle.

15. A method of making a subsea joint, comprising:

providing a manifold having at least one opening defined by a wall;

inserting a stab into said opening with an ROV;

configuring a seal assembly on said stab so as not to materially increase the insertion force required for said advancing; and actuating with the ROV said seal assembly into a sealing engagement with said wall after insertion by forcing said seal into compression longitudinally which, in turn, pushes said seal radially into contact with said opening;

releasing the stab by the ROV with said seal assembly actuated.

16. A method of making a subsea joint, comprising:

providing a manifold having at least one opening defined by a wall;

inserting a stab into said opening;

configuring a seal assembly on said stab so as not to materially increase the insertion force required for said advancing; and actuating said seal assembly into a sealing engagement with said wall after insertion;

using at least one seal with a circumferential opening on said seal assembly;

advancing a support toward said opening after inserting said stab into said opening; and moving a portion of said seal outwardly toward said wall with said support.

17. The method of claim 16, further comprising:

using two opposed seals spaced by said support;

aligning said openings in said seals to face each other on opposite ends of said support;

advancing a nut into the assembly of said seals and said support;

forcing said assembly against a shoulder on said stab; and actuating said seals by forcing said assembly against said shoulder on said stab.

18. The method of claim 17, further comprising:

using a remotely operated vehicle to advance said nut by rotating; and disposing said seals to straddle a flowpath in said manifold.

19. A high pressure stab insertable into a manifold opening for sealing engagement with a wall thereof, comprising:

a body having a longitudinal axis;

at least one seal;

an actuator on said body movably mounted to engage said seal to push it longitudinally whereupon it expands radially into sealing engagement with the wall of said opening after said body is inserted into said opening.

20. The stab of claim 19, wherein:

said actuator comprises a threaded nut; and said seal being insertable into an opening in the manifold without interference with the wall defining the manifold opening until said nut is rotated.

21. A high pressure stab insertable into a manifold opening for sealing engagement with a wall thereof, comprising:

a body;

at least one seal;

an actuator on said body movably mounted to engage said seal to push it into sealing engagement with the wall of said opening after said body is inserted into said opening;

said seal further comprises a circumferential opening; and said actuator enlarging said opening in said seal to push a portion thereof against the wall.

22. The stab of claim 21, further comprising:

a shoulder on said body;

a support ring;

a pair of seals, one on each end of said ring, each said seal having an opening oriented toward said support ring; and said actuator pushing the assembly of said seals and support ring against said shoulder to actuate said seals.

* * * * *